US007001174B2

(12) United States Patent
Hu et al.

(10) Patent No.: US 7,001,174 B2
(45) Date of Patent: Feb. 21, 2006

(54) ELECTRONIC LIGHTER WITH A LOCK DEVICE

(75) Inventors: Shugen Hu, Hangzhou (CN); Yun Wang, Hangzhou (CN); Yujiang Gou, Hangzhou (CN); Changlin Huang, Hangzhou (CN)

(73) Assignees: Zhejiang University, (CN); Ningbo Xinhai Electronics Manufacture Co., Ltd., (CN)

( * ) Notice: Subject to any disclaimer, the term of this patent is extended or adjusted under 35 U.S.C. 154(b) by 21 days.

(21) Appl. No.: 10/499,591

(22) PCT Filed: Aug. 29, 2003

(86) PCT No.: PCT/CN03/00728

§ 371 (c)(1),
(2), (4) Date: Jun. 18, 2004

(87) PCT Pub. No.: WO2004/020904

PCT Pub. Date: Mar. 11, 2004

(65) Prior Publication Data

US 2005/0042561 A1 Feb. 24, 2005

(30) Foreign Application Priority Data

Aug. 30, 2002 (CN) ..... 02266769 U

(51) Int. Cl.
*F23D 11/36* (2006.01)

(52) U.S. Cl. ..... 431/153; 431/255

(58) Field of Classification Search ..... 431/153, 431/255, 277, 354
See application file for complete search history.

(56) References Cited

U.S. PATENT DOCUMENTS

| | | | | |
|---|---|---|---|---|
| 4,859,172 | A | 8/1989 | Nitta | |
| 5,145,358 | A | 9/1992 | Shike et al. | |
| 5,662,466 | A | 9/1997 | Cheng | |
| 5,829,963 | A | 11/1998 | Ichikawa | |
| 6,086,358 | A | 7/2000 | Potskhishvili et al. | |
| 6,142,767 | A | 11/2000 | Chan | |
| 6,287,109 | B1 | 9/2001 | Hirota | |
| 6,506,046 | B1 | 1/2003 | Luo | |
| 6,520,768 | B1 * | 2/2003 | Hsu | 431/153 |
| 6,533,575 | B1 * | 3/2003 | Man | 431/153 |
| 6,808,386 | B1 * | 10/2004 | Huang | 431/153 |

* cited by examiner

*Primary Examiner*—Alfred Basichas
(74) *Attorney, Agent, or Firm*—Ostrolenk, Faber, Gerb & Soffen, LLP

(57) ABSTRACT

An electronic lighter with locking device comprises a gas storage chamber (13), a piezoelectric unit (15) and a gas outlet assembly (16) above the chamber. The piezoelectric unit includes a snapper (8) and a piezoelectric chunk (11). The gas outlet assembly (16) includes a pry plate (2) and a gas outlet valve (3). A slot (9) is made on the snapper (8), which has a circular open groove (92) at its end. A swinging button (7) is provided inside the slot (9), which is able to rotate and equipped with a long arm (72) that is able to rotate around the open groove (92). The piezoelectric chunk has a protrusion (111). When lighter is at a locking position, the button (7) is not allowed to move downward because its long arm (72) is located above the protrusion (111). For assuring the safety of lighter and preventing from incorrect operation, combined with the snapper, a locking mechanism is provided in this invention. If the swing button is at a locking position, the piezoelectric chunk will not produce electronic current to make a spark, and the inflammable gas cannot escape from the gas outlet even though pressing the snapper.

17 Claims, 4 Drawing Sheets

ELECTRONIC LIGHTER WITH A LOCK DEVICE

TECHNOLOGICAL FIELD OF THE INVENTION

This invention relates to an electronic lighter, especially to a lighter with a locking device.

BACKGROUND OF THE INVENTION

The common lighters use the inflammable gases such as butane and natural gas as their fuel, which are widely used for firing in everyday life. This kind of lighter has a gas storage chamber, and a piezoelectric unit and gas outlet element in that chamber. The piezoelectric unit includes piezoelectric chunk, and snapper above that chunk. In use, the inflammable gas will get out from the gas outlet and a spark will be produced by an instant strong current from the piezoelectric chunk when press the snapper with finger. As a result, the gas will be ignited. Because the snapper, piezoelectric chunk and gas outlet are linked through a pry plate, the lighter is easy to be fired with touching the snapper accidentally or unconsciously, and by kids. Therefore, the kids will be hurt, and it is harmful to the public as well. So the lighters without locking device have been or will be forbidden for production and sale by law in some countries.

A great number of patents in relation to locking mechanism for lighter have been issued for this purpose such as the following: U.S. Pat. No. 5,829,963, U.S. Pat. No. 6,506,046, U.S. Pat. No. 5,145,358, U.S. Pat. No. 6,142,767, U.S. Pat. No. 5,662,466, U.S. Pat. No. 6,287,109 and so on.

Among them, different kinds of locking mechanisms have been adopted, including those with slide or rotary button. The lighters with those locking mechanisms are either structurally complicated or their configurations are not rational so to make the size overlarge. For example, due to that side spring and transverse moving bar have been adopted in the locking mechanism described in the American Patent U.S. Pat. No. 6,506,046, the lighter therefore has bigger chamber. The present invention overcomes the disadvantages of the prior art technology and presents a smaller lighter with locking device that is easy for use.

SUMMARY OF THE INVENTION

The present invention provides an electronic lighter with a locking device or mechanism which can overcome the shortcomings in the existing products, so that no spark occurs from the piezoelectric chunk and no gas escapes if you press the snapper only. This is because a locking mechanism is equipped for controling the gas outlet.

The electronic lighter of the present invention comprises a chamber for gas storage, and a piezoelectric unit and gas outlet assembly (16) above the chamber and at its two sides. The piezoelectric unit includes a snapper and a piezoelectric chunk, and the gas outlet assembly includes a pry plate and a gas outlet valve. There is a slot with a circular open groove at its end on the snapper. The swinging button sits inside the slot, which can rotate freely. The swinging button has a long arm that can rotate along the open slot. The piezoelectric chunk is specially configured with a protrusion. When the swinging button is at a locking position, its long arm is located above the protrusion. So, the swing button is not able to move downward. If you don't push the swing button, the button is located above the piezoelectric chunk, the pry plate will not move down because you cannot press the snapper down. As a result, the piezoelectric chunk is not able to produce instant strong electric current to make a spark, and the gas outlet valve will not open and the inflammable gas can't escape from it. As long as the swing button is pushed and its position changes, two shoulders of the snapper can push one end of the pry plate down, then the gas outlet open to let gas out and the piezoelectric chunk produces an instant strong electric current to make a spark when you press the snapper.

The slot is triangle or fan-shaped.

There is a blind hole on the bottom of the slot at its another end. The swinging button has a short arm that can be set into the blind hole. The long arm of the button rotates around the short arm.

The swinging button is equipped with a state restoration mechanism.

The state restoration mechanism is a torsion spring that is wrapped on the short arm of the button and set in the blind hole. Its one end is inserted in the bottom of a groove for the spring, and another end is touched with the side surface of the swing button.

The state restoration mechanism may also be a V-shaped reed that is set between the side surface of the slot and the button.

In another embodiment, there is a plug-in groove on the internal wall of the slot. The end of the button is inserted into the plug-in groove. The end of the button is made up into a bended shape.

There are two shoulders at one side of the snapper that are above the pry plate.

The invention also provides a locking device for electronic lighters. The electronic lighter with the locking device comprises a snapper, a piezoelectric chunk and a pry plate. On the snapper, there is a slot with a circular open groove at its one end. A swinging button is set inside the groove and is able to rotate. The button has a long arm that can rotate along the open groove. The piezoelectric chunk is provided with a protrusion. When the button is at a locking position, its long arm is located above the protrusion and the button is not able to move down.

For assuring the safety of lighter and preventing from incorrect operation, combined with the snapper, a swinging button has been added on the snapper in this invention. If the button is at a locking position, the piezoelectric chunk will not produce electric current to make a spark, and the inflammable gas can't escape from outlet even though you press the snapper.

DETAILED DESCRIPTION OF THE PREFERRED EMBODIMENTS

Figure 1:
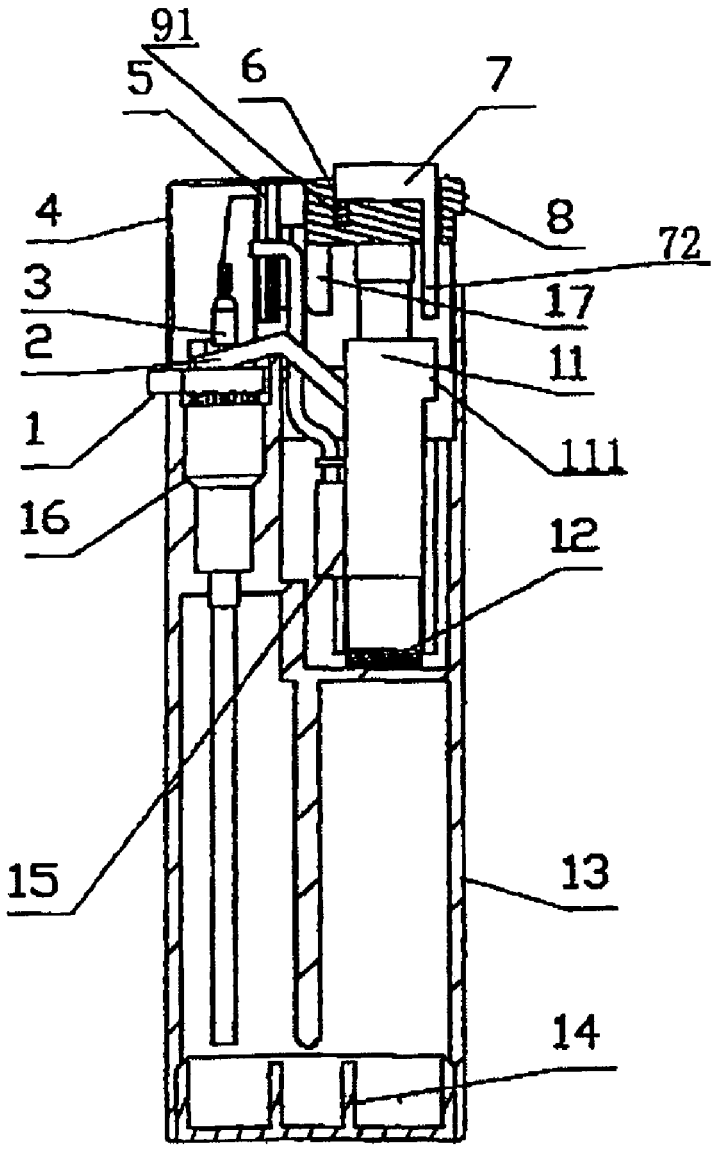
FIG. 1 is a schematic view of the lighter of the present invention.

As shown in FIGS. 1–7, the electronic lighter with locking device of the present invention comprises a chamber for gas storage (13), and a piezoelectric unit (15) and a gas outlet assembly (16) above the chamber at its two sides. The piezoelectric unit (15) includes a snapper (8), a piezoelectric chunk (11) and a piezoelectric rubber pad (12). The gas outlet assembly (16) includes a fire adjustment ring (1), a pry plate (2) and a gas outlet valve (3). On the snapper (8), there is a fan-shaped slot (9) with a blind hole (91) at its small end and a circular open groove (92) at its big end. The blind hole (91) is the circular center of the circular open groove (92) and the distance between the blind hole (91) and open groove (92) is its radius. A η-shaped swinging button (7) is set inside the fan-shaped slot (9). The short arm (71) of the swing button is inserted into the blind hole (91), which is able to rotate in the hole (91), and its long arm goes through the open groove (92), which is able to swing along the groove (92). The long arm (72) of the button (7) is positioned above the piezoelectric chunk (11). The chunk (11) is configured with a protrusion (111) towards outside. The protrusion matches the long arm (72). When the swing button is at locking position, the long arm (72) is located above the protrusion (111) and therefore not able to move downward. Consequently, the lighter is ensured to be safe. In the working state, the long arm can swing apart from the protrusion and move downward, so that the lighter then ignites. As shown in the Figures, the long arm is moved apart from the protrusion. There is a restoring spring at a side of the swing button (7). In this embodiment, the restoring spring is a torsion spring (6) that is wrapped on the short arm (71) of the swing button (7) and is put into the blind hole (91) on the bottom of the fan-shaped slot (9). One end of the torsion spring (6) is inserted into a torsion spring groove (93) on the bottom of the fan-shaped slot (9), and its other end is positioned at the side surface of the button (7). On the side of the snapper (8) facing the gas outlet assembly (16), there are two shoulders (81) going from outside to inside, which are above the pry plate (2). One end (22) of the pry plate (2) above the gas outlet (16) is contacted with the gas outlet valve (3), and another end (21) is located in the space between the piezoelectric chunk (11) and the chamber for gas storage and right below the two shoulders (81). When pushing the swing button (7) and pressing the snapper (8) downward, the two shoulders (81) will push the end (21) of the pry plate (2) downward and make the another end (22) go upward, then the gas outlet valve (3) opens. The fire adjustment ring (1) is used for adjusting the strength of fire, and the air shield (4) for preventing from wind blowing, the inner shield (5) for fire insulation, the piezoelectric chunk (11) for starting a spark, the storage chamber (13) for storing gas, the bottom cup (14) for sealing and the piezoelectric rubber pad (12) plays a cushion function.

Figure 6:
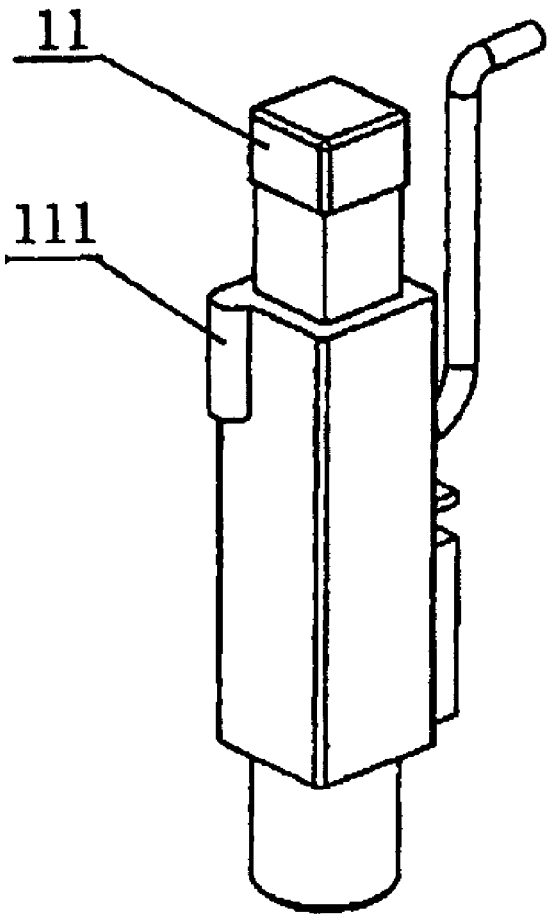
FIG. 6 is a three-dimensional view of the piezoelectric chunk of the present invention.
Figure 7:
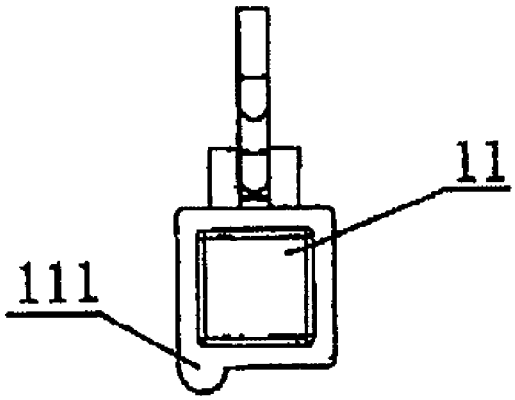
FIG. 7 is a top view of FIG. 6.

Referring to FIGS. 6 and 7, the function of the protrusion (111) on the piezoelectric trunk will be explained in detail. The protrusion is a protruding semi-cylinder at the middle of the piezoelectric chunk. In a locking state, the long arm (72) of the swinging button (7) is not able to move downward as the protrusion (111) is located right below the long arm (72). In a working state, the long arm (72) is able to move downward as there is a space near and apart from the protrusion. Besides a semi-cylinder, the shape of the protrusion (111) can be a rectangle or triangle shape or other suitable shapes.

The restoring spring of the swing button may not be a torsion spring (6) only, but a V-shaped reed spring can also be used. The reed can be set between the side surface of the slot (9) and button (7). Its two ends will be disposed at the sidewall of the slot (9) and the side surface of the button (7) respectively. The working state of the swinging button (7) will be restored to a locking state by the reed's elasticity.

Figure 2:
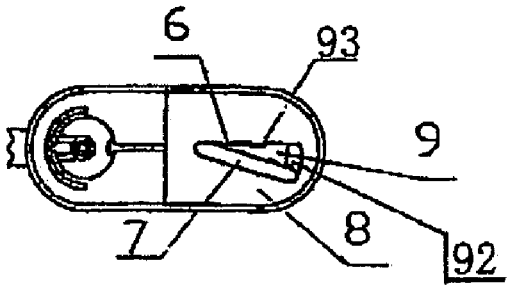
FIG. 2 is a top view of FIG. 1.
Figure 3:
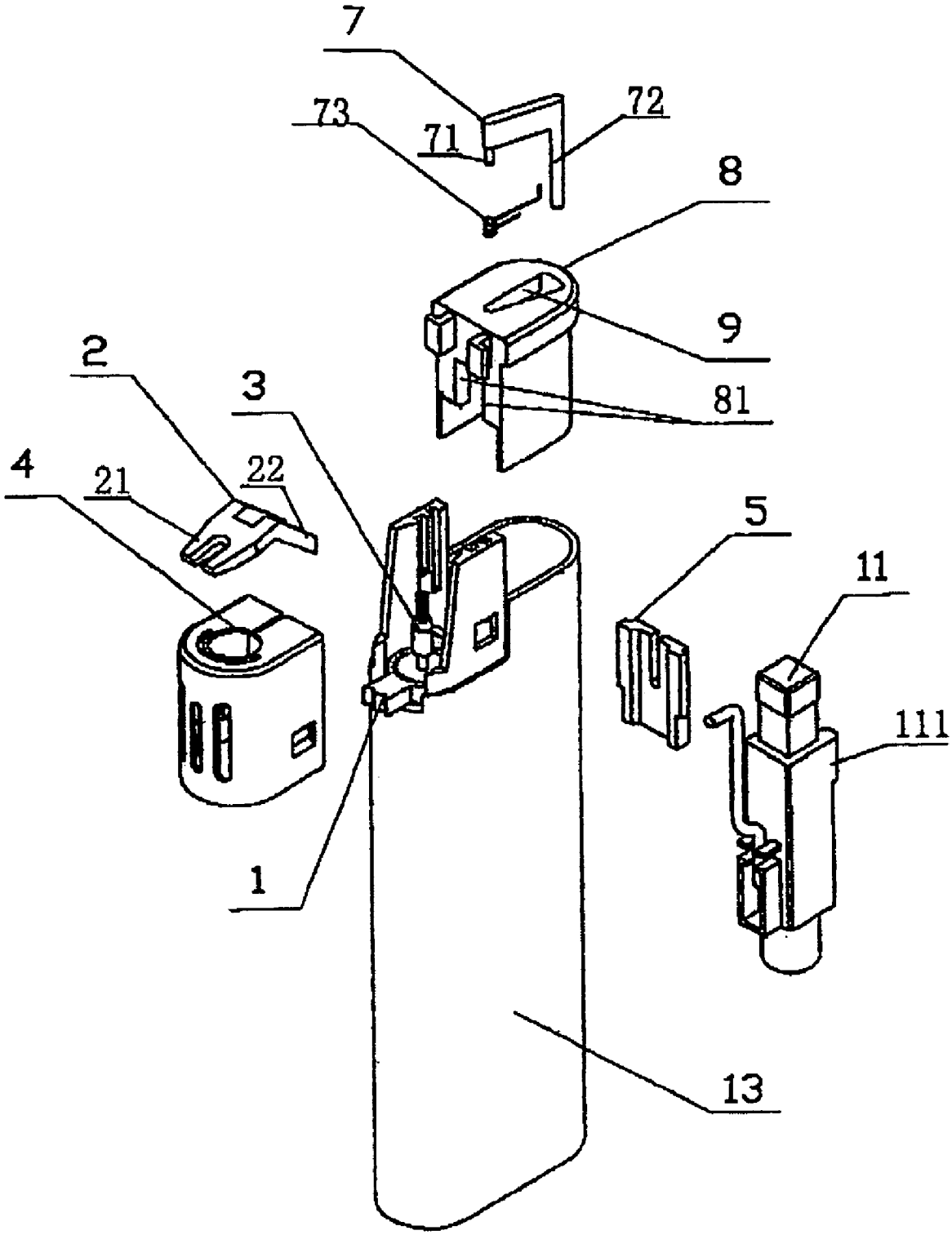
FIG. 3 is a schematic view of the detached lighter of the present invention.

FIGS. 1 and 2 are the schematic view of the present invention in a locking state. In this state, if pressing the snapper (8), it is not able to move downward to press the piezoelectric chunk (11), and not able to open the gas outlet assembly (16) to let the inflammable gas get out because the long arm (72) of the swing button (7) is right above the protrusion (111) of the piezoelectric chunk, and the protrusion prevents the arm from going down. As the snapper (8) can't move down to press the piezoelectric chunk to start a spark, the lighter would not be ignited. Consequently, accidents caused by incorrect operation or by kids can be avoided.

Figure 4:
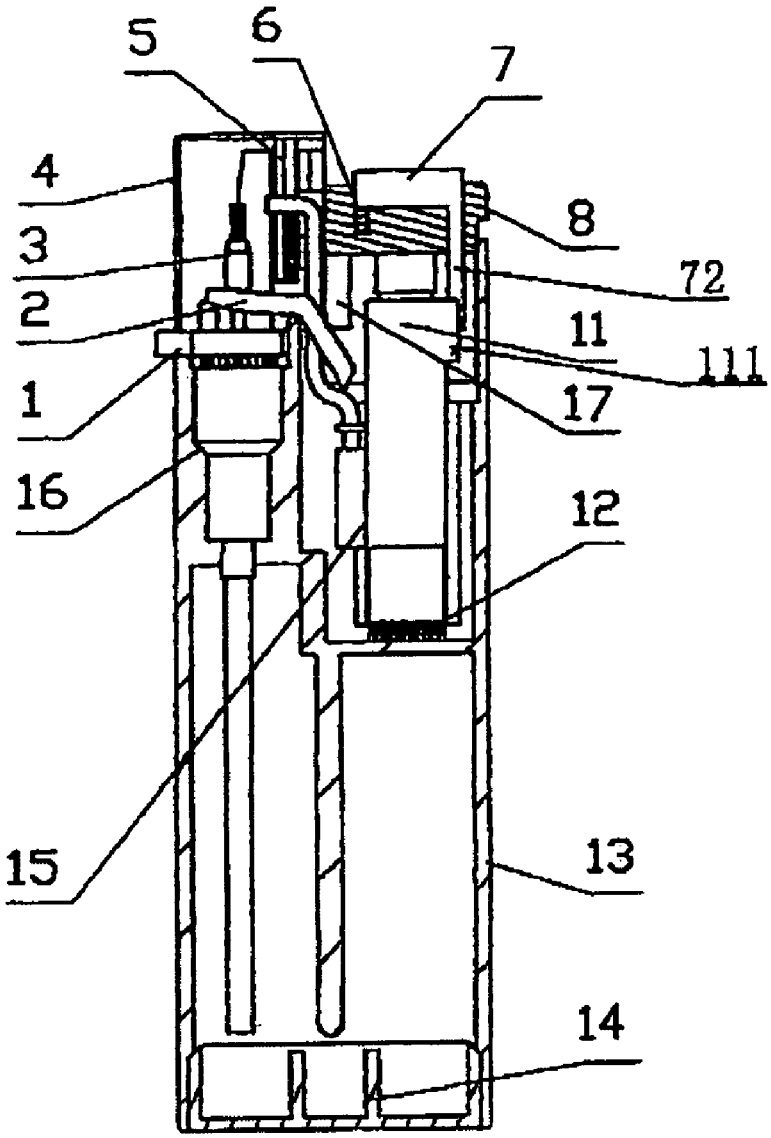
FIG. 4 is a schematic view of the lighter of the present invention at its working state.
Figure 5:
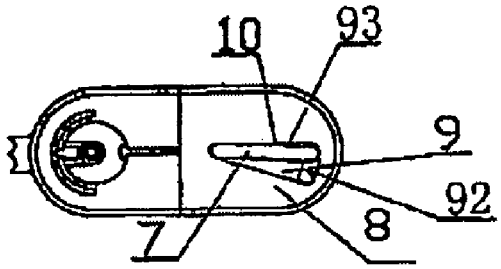
FIG. 5 is a top view of FIG. 4.

FIGS. 4 and 5 are the schematic views of the lighter of the present invention in a working state. When a pushing force is exerted on it, the swinging button (7) will rotate towards the left (the direction shown in the FIG. 2) inside the fan-shaped slot (9) of the snapper (8), and the long arm (72) of the button (7) will rotate apart from the previous position where it was right above the protrusion (111) of the piezoelectric chunk (11) to the present position where it is right above the empty place near the protrusion (111). In this state, if pressing the snapper (8), the piezoelectric chunk (11) will be pushed down, and at the same time, the two shoulders (81) on the snapper (8) will press one end (21) of the pry plate (2) downward, then make another end (22) of the pry plate (2) go up to open the outlet valve (3). Therefore, the lighter will be ignited. When the force is gone, the snapper will return to its original position, and the button (7) will return to its original position by virtue of the restoring torque of the restoring spring. Then, the locking state is restored.

As a modification, the swinging button can be made of some materials with elasticity and rigidity such as metals, plastics and so on. As a result, the restoring spring can be omitted. A plug-in groove can be made on the top wall or sidewall of the slot at its small end, and the end of the swing button can then be inserted into the groove. In a preferred embodiment, such a plug-in groove will be set on the sidewall of the fan-shaped slot, and the end of the swing button will be made up into a bended shape, then inserted in the plug-in groove as to make the button fixed into the fan-shaped slot. When ignition is needed, push the swing button against its elasticity towards the end of the circular open slot. After finishing, release the button, and the button will return to its original (locking) position by virtue of its elasticity.

The invention includes but is not limited to the above-discussed embodiments. By installing a swinging button on the snapper and control the gas outlet component with button swinging, the inflammable gas will not be released from the lighter with this kind of device and fired. For example, the state restoration mechanism as above-discussed can be a reed, spring or torsion spring. The swinging button mentioned can be a η-shaped equivalent mechanism made from plastic or metal.

What is claimed is:

1. An electronic lighter with a locking mechanism, comprising a gas storage chamber (13) and a piezoelectric unit (15) and a gas outlet assembly (16) above the chamber, the piezoelectric unit (15) including a snapper (8) and a piezoelectric chunk (11), the gas outlet assembly (16) including a pry plate (2) and a gas outlet valve (3), the locking mechanism including a slot (9) formed on the snapper (8) and having a circular open groove (92) at its end, a swinging button (7) positioned inside the slot (9) for being able to rotate and equipped with a long arm (72) that is able to rotate along the open groove (92), the piezoelectric chunk configured with a protrusion (111), so that at a locking position, the swing button (7) is not allowed to move downward because its long arm (72) is located above the protrusion (111).

2. The electronic lighter of the claim 1, wherein the slot (9) is triangle or fan-shaped.

3. The electronic lighter of the claim 1, further comprises a blind hole (91) on the bottom of the slot (9) at its one end, and the swing button has a short arm (71) that is installed inside the hole (91), and the long arm (72) rotates around the short arm (71).

4. The electronic lighter of the claim 1, wherein the swinging button (7) has a state restoration mechanism.

5. The electronic lighter of the claim 4, wherein the state restoration mechanism is a torsion spring (6) that is wrapped around the short arm (71) and installed in the blind hole (91) on the bottom of the slot (9) at its small end, and one end of the torsion spring is inserted into a groove for the torsion spring (10) on the bottom of the slot and another end is positioned at the side surface of the swing button (7).

6. The electronic lighter of the claim 4, the state restoration mechanism is a V-shaped reed located between the side surface of the slot and the swinging button.

7. The electronic lighter of the claim 1, further includes a plug-in groove on the inner wall of the slot (9), and the end of the swing button is inserted into the plug-in groove.

8. The electronic lighter of the claim 1 wherein the plug-in groove is provided on the sidewall of the slot (9), and the end of the swing button is formed into a bended shape.

9. The electronic lighter of the claim 1, wherein two shoulders (81) configured at the side of the snapper (8) are above the pry plate (2).

10. A locking device for use in an electronic lighter which comprises a snapper (8), a piezoelectric chunk (11) and a pry plate (2), comprises a slot (9) made on the snapper (8), which has a circular open groove (92) at its end, and a swinging button (7) positioned inside the slot (9) for being able to rotate and equipped with a long arm (72) that is able to rotate along the open groove (92), the piezoelectric chunk (11) configured with a protrusion (111), so that at a locking position, the swing button (7) is not allowed to move downward because its long arm (72) is located above the protrusion (111).

11. The locking device of the claim 10, wherein the slot (9) is triangle or fan-shaped.

12. The locking device of the claim 10, further comprises a blind hole (91) on the bottom of the slot (9) at its end, and the swing button comprises a short arm (71) that can be installed inside the hole (91) and the long arm (72) rotates around the short arm (71).

13. The locking device of the claim 10, wherein the swinging button (7) has a state restoration mechanism.

14. The locking device of the claim 13, wherein the state restoration mechanism is a torsion spring (6) that is wrapped around the short arm (71), and installed into the blind hole (91) on the bottom of the slot (9) at its small end, and one end of the torsion spring is inserted into a groove for the torsion spring (10) on the bottom of the slot and another end is positioned at the side surface of the swing button (7).

15. The locking device of the claim 13, wherein the state restoration mechanism is a V-shaped reed set between the side surface of the slot and the swinging button.

16. The locking device of the claim 10, further comprises a plug-in groove on the inner wall of the slot (9), and the end of the button is inserted into the plug-in groove.

17. The locking device of the claim 10, wherein the plug-in groove is set on the sidewall of the slot (9) and the end of the swing button is formed into a bended shape.

* * * * *

UNITED STATES PATENT AND TRADEMARK OFFICE

CERTIFICATE OF CORRECTION

PATENT NO. : 7,001,174 B2
APPLICATION NO. : 10/499591
DATED : February 21, 2006
INVENTOR(S) : Hu et al.

It is certified that error appears in the above-identified patent and that said Letters Patent is hereby corrected as shown below:

Please correct the title page at line "(73) Assignee":

Change "Zhejiang University, (CN); Ningbo Xinhai Electronics Manufacture Co., Ltd., (CN)"

to -- Ningbo Xinhai Electronics Manufacture Co., Ltd., (CN); Zhejiang University, (CN) --.

Signed and Sealed this

Eighteenth Day of March, 2008

JON W. DUDAS
*Director of the United States Patent and Trademark Office*